US012662713B2

(12) United States Patent
Jang et al.

(10) Patent No.: US 12,662,713 B2
(45) **Date of Patent: *Jun. 23, 2026**

(54) HOT STAMPING COMPONENT AND MANUFACTURING METHOD THEREFOR

(71) Applicant: Hyundai Steel Company, Incheon (KR)

(72) Inventors: Min Ho Jang, Incheon (KR); Kun Woo Chang, Incheon (KR)

(73) Assignee: Hyundai Steel Company, Incheon (KR)

( * ) Notice: Subject to any disclaimer, the term of this patent is extended or adjusted under 35 U.S.C. 154(b) by 82 days.

This patent is subject to a terminal disclaimer.

(21) Appl. No.: 18/400,073

(22) Filed: Dec. 29, 2023

(65) Prior Publication Data

US 2024/0141473 A1 May 2, 2024

Related U.S. Application Data

(63) Continuation of application No. PCT/KR2022/001490, filed on Jan. 27, 2022.

(30) Foreign Application Priority Data

Jun. 30, 2021 (KR) ..... 10-2021-0086120

(51) Int. Cl.
*C21D 8/02* (2026.01)
*B21D 22/02* (2006.01)
(Continued)

(52) U.S. Cl.
CPC ..... *C21D 8/02* (2013.01); *B21D 22/022* (2013.01); *C21D 8/0221* (2013.01); *C21D 8/0278* (2013.01)

(58) Field of Classification Search
None
See application file for complete search history.

(56) References Cited

U.S. PATENT DOCUMENTS 10,144,196 B2 12/2018 Nakajima et al.
2014/0057130 A1 2/2014 Flechtner et al.
(Continued)

FOREIGN PATENT DOCUMENTS

CN 103476968 A 12/2013
JP 2007-063578 A 3/2007
(Continued)

OTHER PUBLICATIONS

Office Action issued Feb. 25, 2025 in corresponding Japanese Patent Application No. 2023-579870.
(Continued)

*Primary Examiner* — Xiaobei Wang
(74) *Attorney, Agent, or Firm* — Fox Rothschild LLP

(57) ABSTRACT

A hot stamping component according to an embodiment of the present disclosure includes a steel sheet, a plating layer located on the steel sheet and including Zn, and a surface layer located on the plating layer, wherein the surface layer includes a post-treatment layer including an Si-based inorganic post-treatment agent, a Zn oxide layer located on a same layer as the post-treatment layer on the plating layer, and an inter-diffusion layer located between the plating layer and at least one of the post-treatment layer and the Zn oxide layer to overlap at least one of the post-treatment layer and the Zn oxide layer, the inter-diffusion layer including at least one of Si, Mn, O, Fe, Zn, and SiO, wherein a tensile strength of the steel sheet is 1680 MPa or more.

12 Claims, 6 Drawing Sheets

(51) Int. Cl.
*C21D 8/0221* (2026.01)
*C21D 8/0278* (2026.01)

(56) References Cited

U.S. PATENT DOCUMENTS

| | | | | |
|---|---|---|---|---|
| 2015/0337415 | A1* | 11/2015 | Miyoshi | C22C 38/32 428/626 |
| 2017/0191170 | A1 | 7/2017 | Flechtner et al. | |
| 2018/0236520 | A1 | 8/2018 | Jin et al. | |
| 2018/0251875 | A1 | 9/2018 | Pavlina | |
| 2024/0150901 | A1* | 5/2024 | Suzuki | C23C 2/26 |
| 2025/0075292 | A1* | 3/2025 | Bi | C23C 30/00 |

FOREIGN PATENT DOCUMENTS

| | | | |
|---|---|---|---|
| JP | 2007-291508 | A | 11/2007 |
| JP | 2011-117036 | A | 6/2011 |
| JP | 2014-200997 | A | 10/2014 |
| JP | 5597980 | B2 | 10/2014 |
| JP | 2014-213360 | A | 11/2014 |
| JP | 2015-108193 | A | 6/2015 |
| JP | 2016-029214 | A | 3/2016 |
| JP | 2020-180312 | A | 11/2020 |
| KR | 10-1333977 | B1 | 12/2013 |
| KR | 10-2017-0076009 | A | 7/2017 |
| KR | 10-2018-0095757 | A | 8/2018 |
| KR | 10-2019-0115024 | A | 10/2019 |
| WO | 2019/186930 | A1 | 10/2019 |

OTHER PUBLICATIONS

International Search Report issued Apr. 25, 2022 in corresponding PCT Application No. PCT/KR2022/001490.
Extended European Search Report for European Patent Application No. 22833350, dated Jun. 13, 2025, 11 pages.
Office action dated May 10, 2026 for corresponding Chinese patent application No. 202280054419.8, Chinese Patent Office.

* cited by examiner

| | COMPARATIVE EXAMPLE 1 | COMPARATIVE EXAMPLE 2 | EMBODIMENT 1 |
|---|---|---|---|
| PAINTING PHOTO |  |  |  |
| ADHESION EVALUATION |  |  |  |

HOT STAMPING COMPONENT AND MANUFACTURING METHOD THEREFOR

The present application is a continuation of PCT PCT/KR2022/001490 filed Jan. 27, 2022 which claims the benefit of Korean Application No. 10-2021-0086120 filed on Jun. 30, 2021.

FIELD

The present disclosure relates to a hot stamping component and a method of manufacturing the same.

BACKGROUND

High-strength steel is used in vehicle parts for weight reduction and stability. High-strength steel may ensure high strength compared to weight, but as the strength increases, press formability decreases, resulting in material fracture during processing or spring back, which makes it difficult to form products with complex and precise shapes.

One of methods for solving these problems is a hot stamping method, and as interest in this method has increased, research on materials for hot stamping has also been actively conducted. For example, as disclosed in Korean Patent Publication No. 10-2017-0076009, a hot stamping method is a forming technology of manufacturing high-strength parts by heating a steel sheet for hot stamping to a high temperature and then rapidly cooling the steel sheet at the same time while molding it in a press mold.

Related technologies include Korean Patent Publication No. 10-2018-0095757 (entitled "Trimming Method for Hot-Stamped Parts").

A steel sheet for hot stamping has problems in that when heated, a surface of the steel sheet may be oxidized and scale occurs, and thus, surface properties and paintability of a product are degraded and corrosion resistance is also inferior to that of a plating material. Accordingly, a separate process such as shot blasting or shot peening to remove the scale is required after forming the product. Alternatively, in order to prevent such problems, a method of inhibiting the oxidation reaction on the surface of the steel sheet by using an Al-based plating layer and increasing corrosion resistance of the steel sheet by inducing formation of an Al passivation film has been used. However, an Al plating material has excellent heat resistance but has inferior corrosion resistance to that of a Zn plating material and increases the manufacturing costs.

However, the paint adhesion and appearance of a Zn-based hot stamping steel sheet may be significantly reduced due to oxidation of Zn occurring during hot stamping heat treatment. To solve this problem, a post-treatment process such as shot peening has been introduced, but this has resulted in additional costs and processes, thereby reducing productivity.

SUMMARY

Embodiments of the present disclosure are to provide a hot stamping component with improved surface properties and paintability and a method of manufacturing the same.

In one aspect, a hot stamping component is provided comprising: a) a steel sheet; b) a plating layer located on the steel sheet and comprising Zn; and c) a surface layer located on the plating layer, wherein the surface layer comprises: (i) an Si layer comprising an Si-based inorganic agent; (ii) a Zn oxide layer located on a same layer as the Si layer; and c) an inter-diffusion layer located between the plating layer and at least one of the Si layer and the Zn oxide layer to overlap at least one of the Si layer and the Zn oxide layer, the inter-diffusion layer comprising at least one of Si, Mn, O, Fe, Zn, and SiO, wherein a tensile strength of the steel sheet is 1680 MPa or more.

In a further aspect, a hot stamping component according to an embodiment of the present disclosure includes a steel sheet, a plating layer located on the steel sheet and including Zn, and a surface layer located on the plating layer, wherein the surface layer includes a post-treatment layer (also referred to herein as a Si-based layer) including an Si-based inorganic post-treatment agent, a Zn oxide layer located on a same layer as the post-treatment layer on the plating layer, and an inter-diffusion layer located between the plating layer and at least one of the post-treatment layer and the Zn oxide layer to overdap at least one of the post-treatment layer and the Zn oxide layer, the inter-diffusion layer including at least one of Si, Mn, O, Fe, Zn, and SiO, wherein a tensile strength of the steel sheet is 1680 MPa or more.

An area fraction of the inter-diffusion layer with respect to a total area fraction of the post-treatment layer may be at least 10% but not more than 80%.

The Si-based layer (also referred to herein as post-treatment layer) may include at least one of Si, Mn, O, Fe, Zn, and SiO as components diffused from the steel sheet and the plating layer, and an oxide of the Si-based post-treatment agent.

An average thickness of the post-treatment layer may be less than an average thickness of the Zn oxide layer, wherein the average thickness of the post-treatment layer is 5% or more and less than 100% of the average thickness of the Zn oxide layer.

The average thickness of the post-treatment layer may range from 0.5 μm to 3 μm, and the average thickness of the Zn oxide layer may range from 1 μm to 10 μm.

An average thickness of the inter-diffusion layer may range from 0.1 μm to 2 μm.

In a further aspect, a method of manufacturing a hot stamping component is provided, the method comprising: 1) heating a steel sheet to which an Si-based inorganic agent is applied on a plating layer comprising Zn; 2) forming a molded body by hot stamping the heated steel sheet; and 3) cooling the molded body, wherein, in the heating step, the Si-based inorganic agent and one or more components of the plating layer form an inter-diffusion layer, an Si layer, and a Zn oxide layer, wherein the inter-diffusion layer is located between the plating layer and at least one of the Si layer and the Zn oxide layer to overlap at least one of the Si layer and the Zn oxide layer, and comprises at least one of Si, Mn, O, Fe, Zn, and SiO, wherein a tensile strength of the steel sheet is 1680 MPa or more.

In a further aspect, a method of manufacturing a hot stamping component according to an embodiment of the present disclosure includes a heating operation of inserting a steel sheet to which an Si-based inorganic post-treatment agent is applied on a plating layer including Zn into a heating furnace and heating the steel sheet, a transfer operation of transferring the heated steel sheet from the heating furnace to a press mold, a forming operation of forming a molded body by hot stamping the transferred steel sheet, and a cooling operation of cooling the molded body, wherein, in the heating operation, the inorganic post-treatment agent and components of the plating layer diffuse to form an inter-diffusion layer, a post-treatment layer, and a Zn oxide layer in which the plating layer is oxidized, wherein the inter-diffusion layer is located between the plating layer and at least one of the post-treatment layer and the Zn oxide layer to overlap at least one of the post-treatment layer and the Zn oxide layer, and includes at least one of Si, Mn, O, Fe, Zn, and SiO, wherein a tensile strength of the steel sheet is 1680 MPa or more.

An area fraction of the inter-diffusion layer with respect to a total area fraction of the post-treatment layer may be at least 10% but not more than 80%.

The post-treatment layer may include at least one of Si, Mn, O, Fe, Zn, and SiO as components diffused from the steel sheet and the plating layer, and an oxide of the inorganic post-treatment agent.

An average thickness of the post-treatment layer may be less than an average thickness of the Zn oxide layer, wherein the average thickness of the post-treatment layer is 5% or more of the average thickness of the Zn oxide layer.

The average thickness of the post-treatment layer may range from 0.5 μm to 3 μm, and the average thickness of the Zn oxide layer may range from 1 μm to 10 μm.

An average thickness of the inter-diffusion layer may range from 0.1 μm to 2 μm.

In the heating operation, the steel sheet may be heated to a target heating temperature ranging from Ac3 to 910° C. in the heating furnace, and heated while remaining in the heating furnace for 120 seconds to 600 seconds.

Before the heating operation, the method may further include a post-treatment operation of forming a pre-post-treatment layer by applying and drying the SI-based inorganic post-treatment agent on the steel sheet on which the plating layer is formed.

In the post-treatment operation, the post-treatment agent may be applied to the steel sheet to a thickness of 0.5 μm to 3 μm to form the pre-post-treatment layer, wherein an amount of the applied inorganic post-treatment agent ranges from 0.5 $g/m^2$ to 3 $g/m^2$.

The post-treatment operation may include drying the steel sheet to which the inorganic post-treatment agent is applied at a temperature of 70° C. to 150° C. for 1 second to 10 seconds.

According to embodiments of the present disclosure, a hot stamping component having improved surface properties and paintability by using inorganic post-treatment and a method of manufacturing the hot stamping component may be provided.

DETAILED DESCRIPTION

Figure 1:
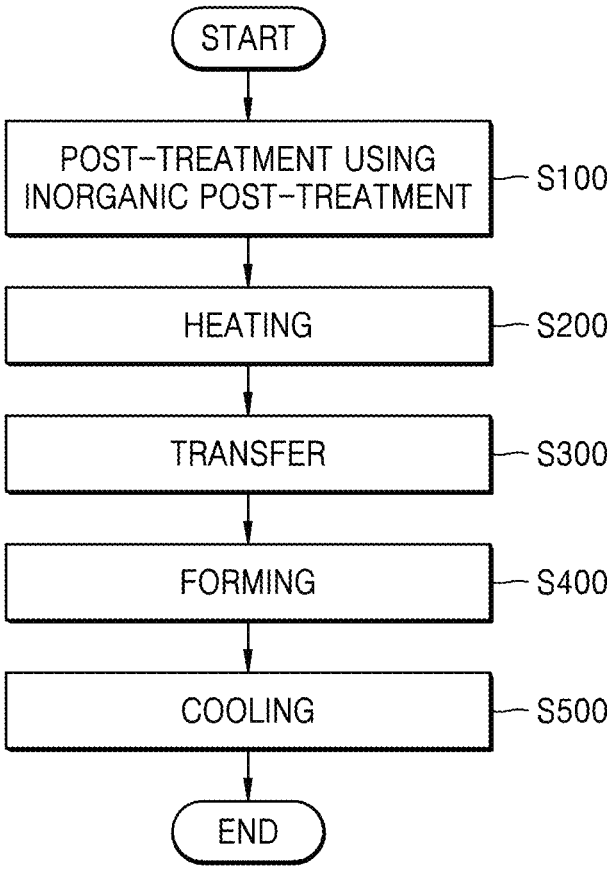
FIG. 1 is a flowchart for describing a method of manufacturing a hot stamping component, according to an embodiment of the present disclosure.

As the present disclosure allows for various changes and numerous embodiments, certain embodiments will be illustrated in the drawings and described in the detailed description. Effects and features of the present disclosure, and methods for achieving them will be clarified with reference to embodiments described below in detail with reference to the drawings. However, the present disclosure is not limited to the following embodiments and may be embodied in various forms.

Although the terms "first," "second," etc. may be used to describe various elements, these elements should not be limited by these terms. These terms are only used to distinguish one element from another.

As used herein, the singular forms "a," "an," and "the" are intended to include the plural forms as well, unless the context clearly indicates otherwise.

It will be further understood that the terms "comprises" or "comprising" used herein specify the presence of stated features or components, but do not preclude the presence or addition of one or more other features or components.

It will be further understood that, when a layer, region, or component is referred to as being "on" another layer, region, or component, it may be directly on the other layer, region, or component, or may be indirectly on the other layer, region, or component with intervening layers, regions, or components therebetween.

Sizes of components in the drawings may be exaggerated or reduced for convenience of explanation. For example, because sizes and thicknesses of elements in the drawings are arbitrarily illustrated for convenience of explanation, the present disclosure is not limited thereto.

When a certain embodiment may be implemented differently, a specific process order may be different from the described order. For example, two consecutively described processes may be performed substantially at the same time or may be performed in an order opposite to the described order.

Hereinafter, embodiments of the present disclosure will be described in detail with reference to the accompanying drawings, wherein the same or corresponding elements are denoted by the same reference numerals throughout.

FIG. 1 is a flowchart for describing a method of manufacturing a hot stamping component, according to an embodiment of the present disclosure.

Referring to FIG. 1, a method of manufacturing a hot stamping component according to an embodiment may include a post-treatment operation S100, a heating operation S200, a transfer operation S300, a forming operation S400, and a cooling operation S500.

In the post-treatment operation S100, an SI-based inorganic post-treatment agent may be applied to a steel sheet on which a plating layer including Zn is formed to form a pre-post-treatment layer and the steel sheet may be dried to prepare a post-treated steel sheet. An operation of preparing the steel sheet on which the plating layer is formed before the post-treatment operation S100 may include preparing a steel slab having a known composition applied for hot stamping, performing at least one of known hot rolling and cold rolling on the steel slab, and then performing annealing heat treatment to manufacture a steel sheet material. After the annealing heat treatment, a Zn plating layer may be formed on the steel sheet material by using a known method.

In the post-treatment operation S100, the pre-post-treatment layer may be formed by drying the steel sheet to which the inorganic post-treatment agent is applied. In this case, the drying may be performed, for example, at a temperature of 70° C. to 150° C. for 1 second to 10 seconds.

A component before hot stamping generated in the post-treatment operation S100 will be described below in detail with reference to FIG. 2.

Next, in the heating operation S200, the steel sheet to which the inorganic post-treatment agent is applied may be inserted into a heating furnace and heated. In the heating operation S200, the steel sheet may be heated to a target temperature to secure a mechanical property (or material property) for the steel sheet in the heating furnace and prevent evaporation of the Zn plating layer, and the target temperature may range from about Ac3 to about 910° C. The steel sheet may be heated while remaining in the heating furnace for about 120 seconds to about 600 seconds in the heating operation S200.

During the heating operation S200, an average heating rate of the steel sheet in a section where a temperature of the steel sheet reaches the target heating temperature from about 700° C. may range from about 1.5° C./sec to about 7° C./sec When the average heating rate ranges from about 1.5° C./sec to about 7° C./sec, components between the plating layer and the post-treatment layer may diffuse to each other and at the same time, mechanical properties (or material properties) of the steel sheet and the plating layer may be secured. When the heating rate is less than about 1.5° C./sec, a mechanical property (or material property) of the steel sheet is not secured and productivity is reduced, and when the heating rate is greater than about 7° C./sec, it is difficult to secure a target plating layer structure due to over-alloying of the plating layer.

According to an embodiment, in the heating operation S200, a step heating operation or a soaking operation may be performed.

The step heating operation may be an operation of heating the steel sheet stepwise, and the soaking operation may be an operation of heating the steel sheet that is step-heated to a uniform temperature. In the step heating operation, a temperature of the steel sheet may be raised stepwise while passing through a plurality of sections provided in the heating furnace. Among the plurality of sections provided in the heating furnace, there may be a plurality of sections in which the step heating operation is performed, and a temperature may be set for each section to be raised from an inlet of the heating furnace through which the steel sheet is inserted toward an outlet of the heating furnace through which the steel sheet is taken out, so that a temperature of the steel sheet is be raised stepwise. After the step heating operation, the soaking operation may be performed. In the soaking operation, the steel sheet that is step heated may be heat treated while passing through a section of the heating furnace set to a temperature of about Ac3 to about 910° C. Also, among the plurality of sections provided in the heating furnace, there may be at least one section in which the soaking operation is performed.

During the heating operation S200, components of the plating layer and the pre-post-treatment layer including the post-treatment agent may diffuse to each other to form an inter-diffusion layer, a second post-treatment layer, and a Zn oxide layer in which the plating layer is oxidized. The inter-diffusion layer may be located between the plating layer and at least one of the second post-treatment layer and the Zn oxidization layer to overlap at least one of the second post-treatment layer and the Zn oxide layer, and may include Si, Mn, O, Fe, Zn, and SiO. The above layers of the component after the heating operation S200 will be described below in detail with reference to FIGS. 3 to 5.

Next, in the transfer operation S300, the heated steel sheet may be transferred from the heating furnace to a press mold. A blank heated in the transfer operation S300 may be air cooled for 5 seconds to 30 seconds.

The forming operation S400 is an operation of forming a molded body by hot stamping the transferred steel sheet. In the forming operation S400, a molding start temperature may range from about 550° C. to about 750° C. When the molding temperature is about 750° C. or higher, cracks of about 10 μm or more may occur in a side wall of the component due to liquid metal embrittlement (LME), thereby reducing durability. In contrast, when the molding temperature is about 550° C. or lower, a mechanical property (or material property) of the steel sheet may be insufficient.

The cooling operation S500 is an operation of cooling the molded body. In the cooling operation S500, an average cooling rate may be about 25° C./sec or more.

A final product may be formed by cooling the molded body at the same time as molding into a final component shape in the press mold. A cooling channel through which a cooling medium circulates may be provided in the press mold. The heated blank may be rapidly cooled by circulating a cooling medium supplied through the cooling channel provided in the press mold. In this case, in order to prevent spring back of a sheet material and maintain a desired shape, the rapid cooling may be performed in a state where the press mold is closed. When the heated blank is formed and cooled, the heated blank may be cooled to a martensite end temperature at an average cooling rate of at least 10° C./s. The blank may remain in the press mold for 3 seconds to 20 seconds. When a time for which the blank remains in the press mold is less than 3 seconds, a material may not be sufficiently cooled, and thus, temperature variation of each portion due to residual heat may affect dimensional quality. Also, because a sufficient amount of martensite is not generated, physical properties may not be ensured. On the other hand, when a time for which the blank remains in the press mold is greater than 20 seconds, the time for which the blank remains in the press mold may increase, thereby reducing productivity.

A hot stamping component controlled through the manufacturing method according to an embodiment of the present disclosure may have improved surface properties and paint adhesion through the inter-diffusion layer formed by diffusing components of the plating layer and the inorganic post-treatment agent. In this case, an area fraction of the inter-diffusion layer with respect to a total area fraction of the second post-treatment layer may be at least 10% but not more than 80%. Also, an average thickness of the second post-treatment layer may be less than an average thickness of the Zn oxide layer formed by oxidizing the Zn plating layer. A specific relationship between the layers will be described below with reference to FIGS. 3 to 5.

Figure 2:
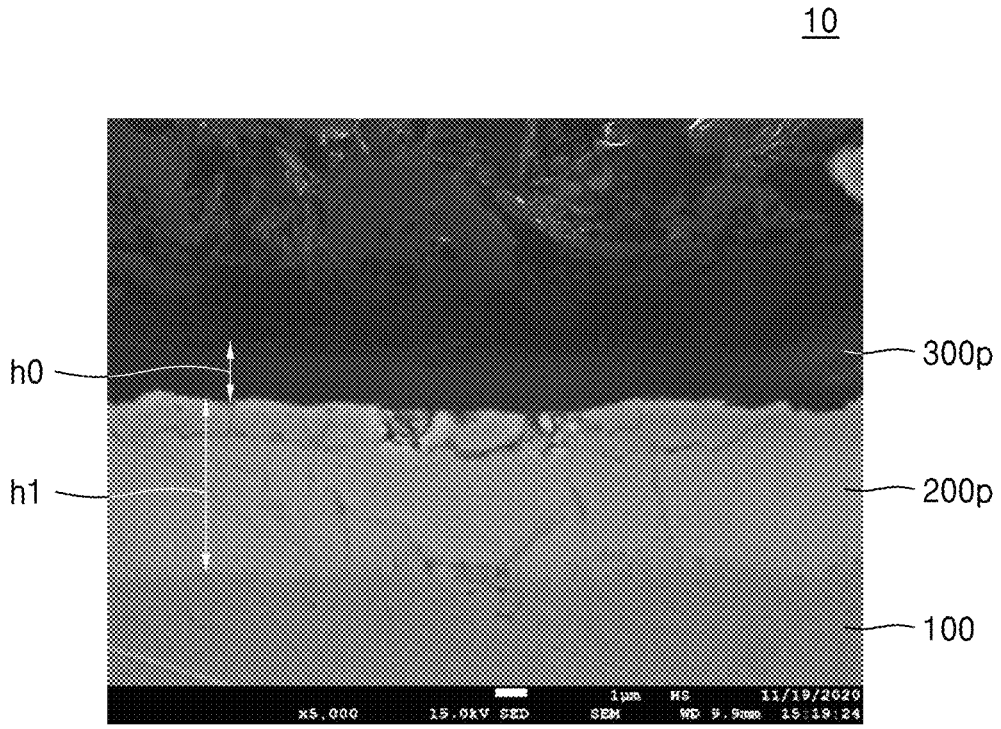
FIG. 2 is a transmission electron microscopy (TEM) image showing a part of a material before a hot stamping process, according to an embodiment of the present disclosure.

FIG. 2 is a transmission electron microscopy (TEM) image showing a part of a material 10 before a hot stamping process (or heating) (hereinafter referred to as a 'hot stamping material'), according to an embodiment of the present disclosure.

The hot stamping material 10 according to an embodiment of the present disclosure may include a steel sheet 100, a plating layer 200*p* before hot stamping, and a pre-post-treatment layer 300*p* on the plating layer 200*p*. Hereinafter, in order to distinguish the post-treatment layer 300*p* of the hot stamping material 10 from a post-treatment layer 310 of a component 20 after a hot stamping process described below, the post-treatment layer 300*p* will be referred to as the 'pre-post-treatment layer 300*p*'.

The steel sheet 100 of the present disclosure may be a steel sheet manufactured by performing a hot rolling process and/or a cold rolling process on a slab cast to include a certain amount of alloying element. The steel sheet 100 may include carbon (C), silicon (Si), manganese (Mn), phosphorus (P), sulfur (S), chromium (Cr), boron (B), molybdenum (Mo), nickel (Ni), an additive, and a balance of iron (Fe), and other unavoidable impurities. Also, in an embodiment, the steel sheet 100 may further include at least one of titanium (Ti), niobium (Nb), and vanadium (V) as an additive. In another embodiment, the steel sheet 100 may further include a certain amount of calcium (Ca).

Carbon (C) may function as an austenite stabilizing element in the steel sheet 100. Carbon may be a major element for determining strength and hardness of the steel sheet 100, and may be added to ensure tensile strength (e.g., a tensile strength of 1,680 MPa or more) and hardenability of the steel sheet 100. Carbon may be included in an amount of 0.25 wt % to 0.50 wt % with respect to a total weight of the steel sheet 100. When a carbon content is less than 0.25 wt %, it is difficult to ensure a hard phase (martensite, etc.), making it difficult to satisfy the mechanical strength of the steel sheet 100. In contrast, when a carbon content is greater than 0.50 wt %, a problem of brittleness or reduced bending performance of the steel sheet 100 may be caused.

Silicon (Si) may function as a ferrite stabilizing element in the steel sheet 100. Silicon (Si) may be a solid solution strengthening element, and improves ductility of the steel sheet 100 and may improve carbon concentration in austenite by suppressing formation of carbides in a low-temperature region. Also, silicon may be a key element in hot rolling, cold rolling, hot pressing, homogenizing a structure (perlite, manganese segregation zone control), and fine dispersion of ferrite. Silicon may function as a martensite strength heterogeneity control element to improve collision performance. Silicon may be included in an amount of 0.10 wt % to 0.8 wt % with respect to a total weight of the steel sheet 100. When a silicon content is less than 0.10 wt %, it is difficult to obtain the above effect, cementite formation and coarsening may occur in a final hot stamping martensitic structure, the uniformization effect of the steel sheet 100 is insignificant, and it is difficult to secure a V-bending angle. In contrast, when a silicon content is greater than 0.8 wt %, loads of hot rolling and cold rolling may increase, hot rolling red scale may become excessive, and plating characteristics of the steel sheet 100 may be degraded.

Manganese (Mn) may function as an austenite stabilizing element in the steel sheet 100. Manganese may be added to increase hardenability and strength during heat treatment. Manganese may be included in an amount of 0.30 wt % to 3.0 wt % with respect to a total weight of the steel sheet 100. When a manganese content is less than 0.30 wt %, a grain refinement effect may not be sufficient, and thus, a hard phase fraction in a formed product after hot stamping may be insufficient due to insufficient hardenability. In contrast, when a manganese content is greater than 3.0 wt %, ductility and toughness may be reduced due to manganese segregation or pearlite band, thereby reducing bending performance and generating a heterogeneous microstructure.

Phosphorus (P) may be included in an amount greater than 0 wt % and equal to or less than 0.05 wt % with respect to a total weight of the steel sheet 100, in order to prevent a decrease in toughness of the steel sheet 100. When a phosphorous content is greater than 0.05 wt %, an iron phosphide compound may be formed, thereby reducing toughness and weldability and generating cracks in the steel sheet 100 during a manufacturing process.

Sulfur (S) may be included in an amount greater than 0 wt % and equal to or less than 0.01 wt % with respect to a total weight of the steel sheet 100. When a sulfur content is greater than 0.01 wt %, hot workability, weldability, and impact characteristics may be degraded, and surface defects such as cracks may occur due to formation of a large inclusion.

Boron (B) may be added to ensure hardenability and strength of the steel sheet 100 by suppressing ferrite, pearlite, and bainite transformation and securing a martensite structure. Also, boron segregates at a grain boundary to lower grain boundary energy to thereby increase hardenability and to increase an austenite grain growth temperature to thereby have a grain refinement effect. Boron may be included in an amount of 0.0005 wt % to 0.005 wt % with respect to a total weight of the steel sheet 100. When boron is included in the above range, hard grain boundary brittleness may be prevented and high toughness and bendability may be ensured. When a boron content is less than 0.0005 wt %, a hardenability effect is insufficient, and in contrast, when a boron content is greater than 0.005 wt %, boron may have low solid solubility, may be easily precipitated at a grain boundary according to a heat treatment condition, hardenability may be degraded or high-temperature embrittlement may be caused, and toughness and bendability may be reduced due to hard grain boundary brittleness.

Chromium (Cr) may be added to improve hardenability and strength of the steel sheet 100. Chromium may enable grain refinement and strength to be secured through precipitation hardening. Chromium may be included in an amount of 0.01 wt % to 1.0 wt % with respect to a total weight of the steel sheet 100. When a chromium content is less than 0.01 wt %, a precipitation hardening effect is poor, and when a chromium content is greater than 1.0 wt %, Cr-based precipitates and matrix solid solution may increase, thereby reducing toughness and increasing raw costs to increase production costs.

Molybdenum (Mo) may be included in an amount of 0.01 wt % to 1.0 wt % with respect to a total weight of the steel sheet 100.

Nickel (Ni) may be included in an amount of 0.001 wt % to 1.0 wt % with respect to a total weight of the steel sheet 100.

An additive may be a nitride or carbide forming element. In detail, the additive may include at least one of titanium (Ti), niobium (Nb), and vanadium (V). Titanium (Ti), niobium (Nb), and vanadium (V) may ensure the strength of a hot stamped and quenched member by forming fine precipitates in the form of nitride or carbide. Also, titanium (Ti), niobium (Nb), and vanadium (V) are included in an Fe—Mn-based composite oxide, function as a hydrogen trap site effective in improving delayed fracture resistance, and are elements required to improve delayed fracture resistance. The additive may be included in an amount of 0.01 wt % to 0.1 wt % with respect to a total weight of the steel sheet 100. When an additive content is greater than 0.1 wt %, yield strength may excessively increase.

Titanium (Ti) may be added to enhance hardenability and improve a mechanical property (or material property) by forming precipitates after hot press heat treatment. Also, titanium effectively contributes to refinement of austenite grains by forming precipitated phase such as Ti(C, N) at a high temperature. Titanium may prevent poor continuous casting and coarsening of precipitates, may easily ensure physical properties of a steel material, and may prevent defects such as cracks in a surface of the steel material.

Niobium (Nb) and vanadium (V) may be added to increase strength and toughness as a martensite packet size decreases. Niobium and vanadium have a high grain refinement effect of a steel material in hot rolling and cold rolling processes, may prevent cracks in a slab and brittle fracture of a product during steel making/continuous casting, and may minimize generation of steel making coarse precipitates.

For example, the steel sheet 100 may have a composition as shown in Table 1. Referring to Table 1, C, Si, Mn, P, S, and B may be essential components, and Cr, Mo, Ni, and an additive may be optional components. An additive may include at least one of, for example, Ti, Nb, and V, and a total amount thereof may range from about 0.01 wt % to about 0.1 wt %.

TABLE 1

| Components (wt %) | | | | | | | | | |
|---|---|---|---|---|---|---|---|---|---|
| C | Si | Mn | P | S | B | Cr | Mo | Ni | Additive |
| 0.25~0.50 | 0.10~0.80 | 0.30~3.0 | 0.05 or less | 0.01 or less | 0.0005~0.005 | 0.01~1.0 | 0.01~1.0 | 0.001~1.0 | 0.01~0.1 |

A structure of the steel sheet 100 of the present disclosure may include, for example, ferrite, pearlite, remaining other unavoidable structures, and other precipitates. Regarding physical properties of the steel sheet 100 of the present disclosure, for example, after hot stamping, a tensile strength (TS) may range from about 1680 MPa to about 2300 MPa, a yield temperature (YP) may range from about 1150 MPa to about 1500 MPa, and an elongation rate (EL) may be about 4% or more and about 10% or less. The plating layer 200*p* of the present disclosure may be a Zn-based plating layer. That is, the hot stamping material 10 of the present disclosure is a galvanized steel sheet, for example, a galva-annealed iron (GA) steel sheet in which the alloyed plating layer 200*p* is formed by heat diffusion of zinc and the steel sheet 100, or a galvanized iron (GI) steel sheet in which the plating layer 200*p* is formed from fine zinc grains formed while molten zinc is solidified on a surface of the steel sheet 100.

The plating layer 200*p* before hot stamping of the present disclosure may include, but is not limited to, Zn and Fe. The plating layer 200*p* may be plated on one surface of the steel sheet 100 with an attachment amount of about 15 g/m$^2$ to about 100 g/m$^2$ (about 30 to 200 g/m$^2$ on both surfaces), and a thickness hi of the plating layer 200*p* may range from about 4 μm to about 30 μm.

The pre-post-treatment layer 300*p* of the present disclosure is a layer formed by applying and drying in the post-treatment operation S100 described with reference to FIG. 1. The pre-post-treatment layer 300*p* will be described in relation to the post-treatment operation S100 described above. The pre-post-treatment layer 300 may include an inorganic post-treatment agent, for example, an Si-based inorganic post-treatment agent. The Si of the pre-post-treatment layer 300*p* is used to form an inter-diffusion layer including SiO on a surface of the steel sheet 100 or the plating layer 200*p* during a hot stamping heat treatment process, thereby improving component characteristics of a hot stamping component, which will be described in the following related drawings in more detail. Because the inorganic post-treatment agent is used in the present disclosure, a problem of an organic post-treatment agent including a carbon (C) chain that durability is reduced due to the chain being cut by heating during a hot stamping process may be solved.

In the post-treatment operation S100, the inorganic post-treatment agent may be applied to the steel sheet 100 to a thickness of about 0.5 μm to about 3 μm to form the pre-post-treatment layer 300*p*. That is, a thickness h0 of the pre-post-treatment layer 300*p* may range from about 0.5 μm to about 3 μm. In this case, the amount of the applied inorganic post-treatment agent may range from about 0.5 g/m$^2$ to about 3 g/m$^2$. The inorganic post-treatment agent of the present disclosure should be applied in this amount to ensure the hot stamping component according to an embodiment of the present disclosure described below and surface properties and paint adhesion of the hot stamping component.

Figure 3:
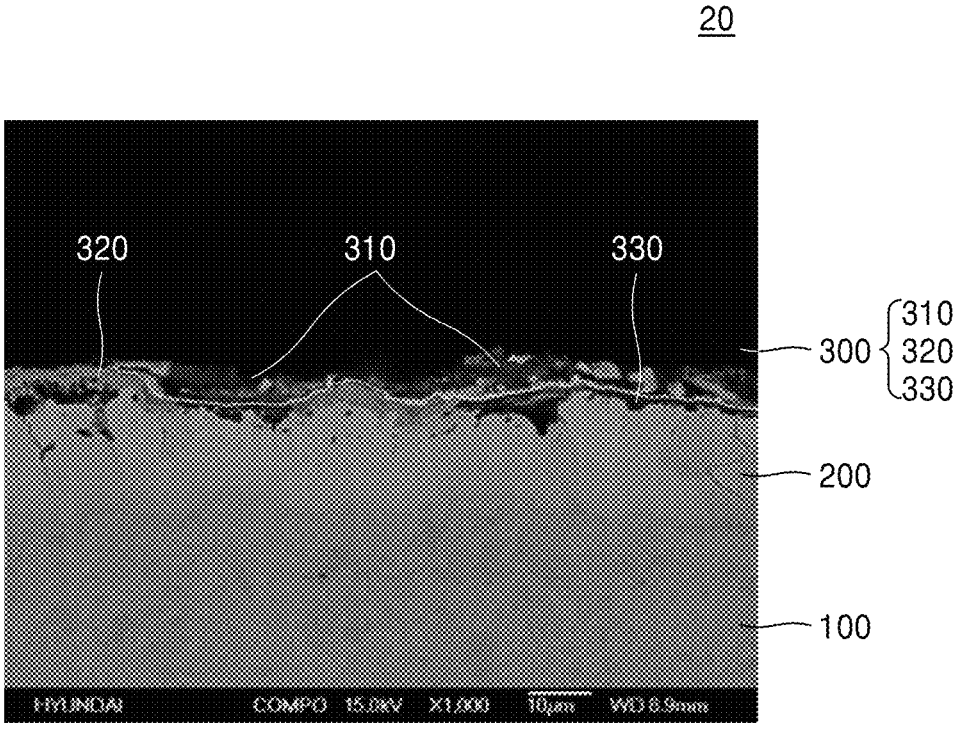
FIG. 3 is a TEM image showing a part of a component after a hot stamping process, according to an embodiment of the present disclosure.
Figure 4:
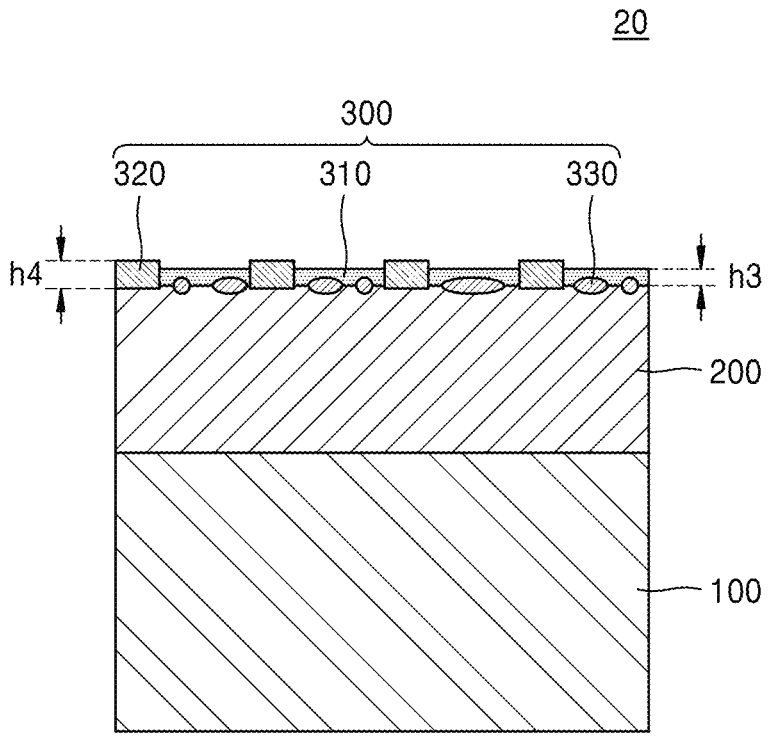
FIG. 4 is a cross-sectional view illustrating a component after a hot stamping process, according to an embodiment of the present disclosure.

Hereinafter, a final component after a hot stamping process will be described with reference to FIGS. 3 and 4 together. FIG. 3 is a TEM image showing a part of a component 20 after a hot stamping process, according to an embodiment of the present disclosure. FIG. 4 is a cross-sectional view illustrating the component 20 after a hot stamping process (hereinafter, referred to as a hot stamping component'), according to an embodiment of the present disclosure. Hereinafter, the hot stamping component 20 may refer to a component after all of the operations S200 to S500 described with reference to FIG. 1 are performed. Substantially the same description as that made with reference to FIG. 2 will be omitted or briefly provided.

The hot stamping component 20 of the present disclosure may include the steel sheet 100, a plating layer 200 including Zn, and a surface layer 300 formed through a hot stamping process. The surface layer 300 may be located on the plating layer 200 and may include a post-treatment layer 310, a Zn oxide layer 320, and an inter-diffusion layer 330. Components of the steel sheet 100 after the hot stamping process may be similar to those of the steel sheet 100 before the hot stamping process described with reference to FIG. 2, but structures may be different from each other. After the hot stamping process of the present disclosure, a structure of the steel sheet 100 may undergo phase transformation and thus, may include, for example, 90% or more of martensite and less than 10% of remaining other unavoidable structures and other precipitates.

The plating layer 200 after the hot stamping process may be formed when components of the plating layer 200*p* and the steel sheet 100 of the hot stamping material 10 diffuse to each other. The plating layer 200 may include at least one of Zn, Fe, Al, Mn, and Si. A composition of the plating layer 200 may include, for example, but is not limited to, 10 to 70 wt % of Fe, 0 to 5 wt % of Al, 0 to 5 wt % of Mn, 0 to 5 wt % of Si, a balance of Zn, and other impurities. The plating layer 200 may be formed to a thickness of about 5 μm to about 50 μm. When a thickness of the plating layer 200 is less than 5 μm, corrosion resistance may be reduced, and when a thickness of the plating layer 200 is greater than 50 μm, productivity may be reduced.

The surface layer 300 may be formed when components of the plating layer 200*p* and the steel sheet 100 of the hot stamping material 10 diffuse into the pre-post-treatment layer 300*p*. Alternatively, during the hot stamping process, the surface layer 300 may be formed when components of the plating layer 200 of the hot stamping component 200 formed by diffusion of components of the plating layer 200*p* and the steel sheet 100 of the hot stamping material 10 diffuse to the post-treatment layer 300*p*. The surface layer 300 may be located on the plating layer 200 and may include the post-treatment layer 310, the Zn oxide layer 320, and the inter-diffusion layer 330.

The post-treatment layer 310 may be located on the plating layer 200 and may include an inorganic post-treatment agent. For example, the post-treatment layer 310 may include a SI-based inorganic post-treatment agent, and compared to the pre-post-treatment layer 300*p*, the post-treatment layer 310 may further include silicon oxide such as SiO where Si is oxidized, and components diffused from the plating layer 200*p* or the steel sheet 100. The post-treatment layer 310 may be formed by mixing an Si-based post-treatment agent, an oxide of the post-treatment agent, and components of the plating layer 200 and the steel sheet 100. Alternatively, the post-treatment layer 310 may be formed by mixing components of the plating layer 200*p* and the steel sheet 100 of the hot stamping material 10. For example, components diffused from the steel sheet 100 or the plating layers 200 and 200*p* may include at least one of Si, O, Mn, Zn, and Fe.

The post-treatment layer 310 may be formed on the plating layer 200 and may suppress and minimize formation of a Zn oxide layer in which a Zn component of the plating layer 200 or 200*p* and oxygen are combined to reduce paint adhesion. As such, the post-treatment layer 310 may suppress formation of Zn oxide that inhibits binding with a painting layer and may induce formation of Si oxide that improves binding with the paining layer, finally improving paint adhesion of the hot stamping component 20. An average Zn content of the post-treatment layer 310 may be less than an average Zn content of the plating layer 200. An average Zn content of the post-treatment layer 310 may be greater than an average Si content of the post-treatment layer 310. For example, a phosphate treatment layer including phosphate may be further located between the post-treatment layer 310 and the painting layer (not shown) formed on the post-treatment layer 310, and the post-treatment layer 310 may have a strong binding force with the phosphate treatment layer, thereby improving paint adhesion.

An average thickness h3 of the post-treatment layer 310 may be less than an average thickness h4 of the Zn oxide layer 320 described below. The average thickness h3 of the post-treatment layer 310 may be about 5% or more and less than 100% of the average thickness h4 of the Zn oxide layer 200. For example, the average thickness h3 of the post-treatment layer 310 may range from about 0.5 μm to about 3 μm, and when the average thickness h3 is 0.5 μm or less, paintability may be degraded. An area fraction of the post-treatment layer 310 with respect to the entire surface layer 300 may range from about 20% to about 100%, and when an area fraction of the post-treatment layer 310 is less than 20%, paintability may be degraded. The post-treatment layer 310 may include at least one of SiO, Zn, Fe, and Mn. A composition of the post-treatment layer 310 may include, for example, 20 to 90 wt % of Si, 0 to 15 wt % of Mn, 10 to 80 wt % of O, 0 to 15 wt % of Fe, and 0 to 15 wt % of Zn, as shown in Table 2.

TABLE 2

| Si | Mn | O | Fe | Zn |
|---|---|---|---|---|
| 20~90 wt % | 0~15 wt % | 10~80 wt % | 0~15 wt % | 0~15 wt % |

The Zn oxide layer 320 may be located on the same layer as the post-treatment layer 310 on the plating layer 200. The Zn oxide layer 320 may be formed by oxidizing zinc in the plating layer 200 during a hot stamping heat treatment process. The Zn oxide layer 320 may reduce surface properties and paint adhesion of the component. The average thickness h4 of the Zn oxide layer 320 may range from about 1 μm to about 10 μm, and when the average thickness h4 is greater than 10 μm, paintability of the component may be degraded. In the present disclosure, a decrease in surface properties and paintability may be solved by reducing a thickness and an area fraction of the Zn oxide layer 320 through formation of the post-treatment layer 310 including the inorganic post-treatment agent described above and the inter-diffusion layer 330 formed from the post-treatment layer 310. The inter-diffusion layer 330 of the present disclosure may be located between the plating layer 200 and at least one of the post-treatment layer 310 and the Zn oxide layer 320 to overlap at least one of the post-treatment layer 310 and the Zn oxide layer 320. In this drawing, the inter-diffusion layer 330 is located between the post-treatment layer 310 and the plating layer 200 and at least a part of the inter-diffusion layer overlaps the post-treatment layer 310 and the plating layer 200. The inter-diffusion layer 330 may include at least one of Si, Mn, O, Fe, Zn and SiO. A composition of the inter-diffusion layer 330 may include, for example, 15 to 35 wt % of Si, 0 to 15 wt % of Mn, 35 to 80 wt % of O, 0 to 15 wt % of Fe, and 5 to 40 wt % of Zn, as shown in Table 3. An average Zn content of the inter-diffusion layer 330 may be greater than an average Zn content of the post-treatment layer 310 described above.

TABLE 3

| Si | Mn | O | Fe | Zn |
|---|---|---|---|---|
| 15~35 wt % | 0~15 wt % | 35~80 wt % | 0~15 wt % | 5~40 wt % |

An area fraction of the inter-diffusion layer 330 with respect to a total area fraction of the post-treatment layer 310 may be at least about 10% but not more than about 80%. When the inter-diffusion layer 330 exists in an amount of 10% or more of the post-treatment layer 310, a binding force between the plating layer 200 and a painting layer (not shown) on the plating layer may be ensured and the Zn oxide layer 320 may be sufficiently reduced to ensure necessary paintability. An average thickness of the inter-diffusion layer 330 may range from, for example, about 0.1 μm to about 2 μm. An average thickness of the inter-diffusion layer 330 may be at least about 10% but not more than about 80% of an average thickness of the post-treatment layer 310.

As such, according to an embodiment of the present disclosure, the surface layer 300 including the post-treatment layer 310 and the inter-diffusion layer 330 formed from the pre-post-treatment layer 300*p* through hot stamping heat treatment may improve paint adhesion of the hot stamping component 20 due to an additional binding force with the plating layer 200. Also, because Zn of the plating layer 200 does not diffuse to a surface by using formation of the inter-diffusion layer 330 using an inorganic post-treatment agent but is rather consumed in the inter-diffusion layer 330 to form the inter-diffusion layer 330 having a higher average Zn content than the post-treatment layer 310, the amount of the Zn oxide layer 320 may be reduced and finally paint adhesion may be improved.

Figure 5:
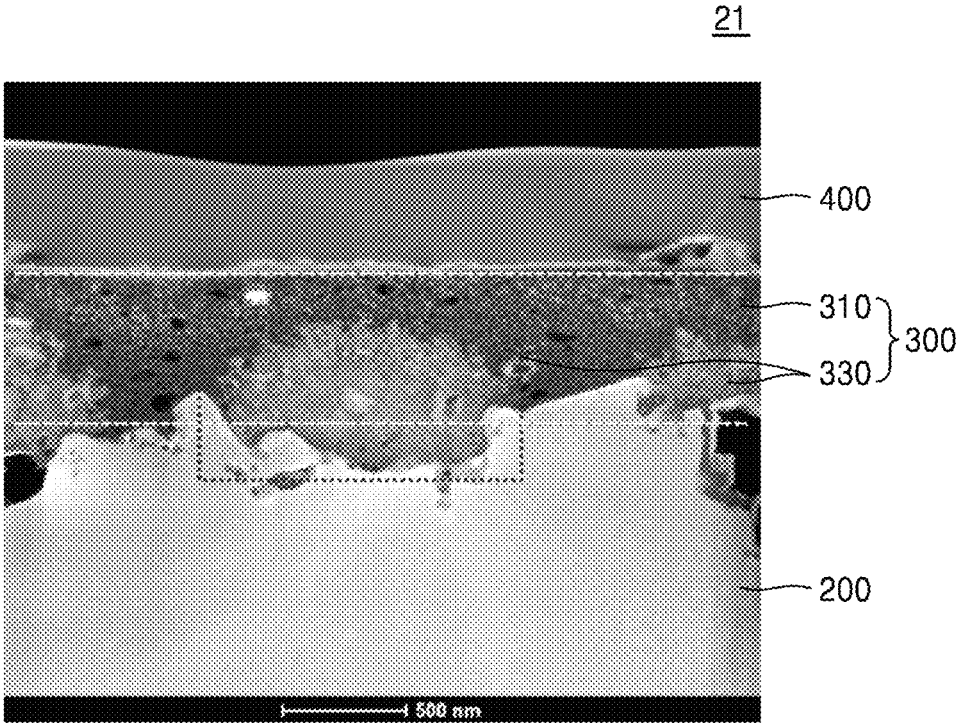
FIG. 5 is an enlarged TEM image showing a part of the component after the hot stamping process of FIG. 2.

FIG. 5 is an enlarged TEM image 21 showing a part of the component after the hot stamping process of FIG. 3. Substantially the same description as that made above will be omitted or briefly provided.

Referring to FIG. 5, the Zn plating layer 200, the surface layer 300 located on the Zn plating layer 200, and a sampling plate 400 for analysis sampling on the surface layer 300 in a hot stamping component 21 are illustrated. The surface layer 300 including the second post-treatment layer 310 and the inter-diffusion layer 330 may function to bind the plating layer 200 located under the surface layer 300 with a painting layer (not shown) on the surface layer 300, and the inter-diffusion layer 330 may function to bind the plating layer 200 with the post-treatment layer 310, finally increasing a binding force between the plating layer 200 and the painting layer and improving surface properties and paint adhesion of the hot stamping component 20.

Figure 6:
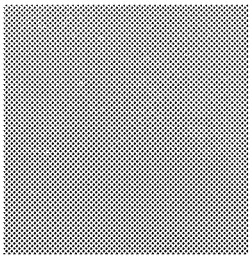
FIG. 6 is a view illustrating an adhesion evaluation result between a hot stamping component according to comparative examples and a hot stamping component according to an embodiment of the present disclosure.
Figure 6:
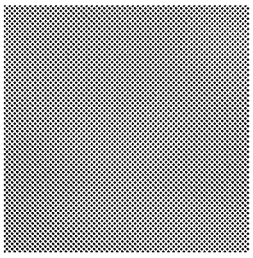
Figure 6:
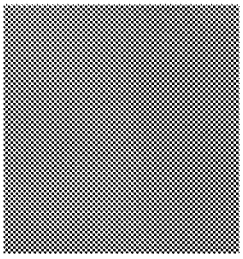
Figure 6:
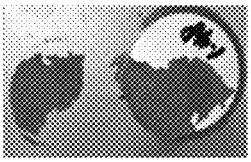
Figure 6:
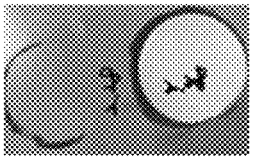
Figure 6:
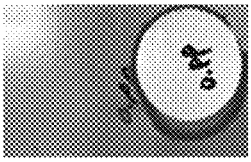

FIG. 6 is a view illustrating an adhesion evaluation result between a hot stamping component according to comparative examples and a hot stamping component according to an embodiment of the present disclosure, Comparative Example 1 corresponds to a case where an inorganic post-treatment agent of the present disclosure was not applied to a galva-annealed iron (GA) steel sheet and a shot peening process was not performed, Comparative Example 2 corresponds to a case where a shot peening process was performed by using shot peening powder on the same GA steel sheet (an inorganic post-treatment agent of the present disclosure was not applied), and Embodiment 1 corresponds to a case where a hot stamping component was manufactured according to an embodiment of the present disclosure (a post-treatment process such as shot peening was not performed).

The adhesion evaluation of FIG. 6 is an example of performing a dolly test, and an adhesive force of a component may be evaluated based on how much material is removed from a surface of the test component when a dolly is fixed on a hot stamping component prepared according to each comparative example or embodiment by using an adhesive and then separated.

First, it is found from Comparative Example 1 where a shot peening process was not performed that a large portion of a painting layer or a plating layer on a surface of a component was removed and attached to a dolly, resulting in poor paintability. On the other hand, it is found from Comparative Example 2 where a shot peening process was performed to improve paintability of a conventional hot stamping component that a surface of the hot stamping component remained almost the same even a dolly was removed, improving paintability. It is found from Embodiment 1 of the present disclosure that a surface of a component remained almost the same even when an inorganic post-treatment agent of the present disclosure was used without performing a post-treatment process such as shot peening or shot blasting. That is, when an inorganic post-treatment agent of the present disclosure is used, even without performing a complex and expensive process such as shot peening, the same surface properties, paintability, and adhesion as the complex and expensive process is performed may be ensured.

While the present disclosure has been particularly shown and described with reference to embodiments thereof, it will be understood by one of ordinary skill in the art that various modifications and equivalent other embodiments made be made from the present disclosure. Accordingly, the true technical scope of the present disclosure is defined by the technical spirit of the appended claims.

The invention claimed is:

1. A hot stamped component comprising:

a steel sheet;

a plating layer located on the steel sheet and comprising Zn; and a surface layer located on the plating layer, wherein the surface layer comprises:

an Si layer comprising an Si-based inorganic agent;

a Zn oxide layer wherein both the Si layer and the Zn oxide layer are on the plating layer; and an inter-diffusion layer located between the plating layer and at least one of the Si layer and the Zn oxide layer, the inter-diffusion layer extending into at least one of the Si layer and the Zn oxide layer and comprising at least one of Si, Mn, O, Fe, Zn, and silicon oxide, wherein an area ratio of the inter-diffusion layer to the Si layer is at least 10% but not more than 80%, and wherein a tensile strength of the hot stamped component is 1680 MPa or more.

2. The hot stamped component of claim 1, wherein the Si layer comprises at least one of Si, Mn, O, Fe, Zn, and silicon oxide as components diffused from the steel sheet and the plating layer, and an oxide of the Si-based inorganic agent.

3. The hot stamped component of claim 1, wherein an average thickness of the Si layer is less than an average thickness of the Zn oxide layer, wherein the average thickness of the Si layer is 5% or more and less than 100% of the average thickness of the Zn oxide layer.

4. The hot stamped component of claim 3, wherein the average thickness of the Si layer ranges from 0.5 μm to 3 μm, and the average thickness of the Zn oxide layer ranges from 1 μm to 10 μm.

5. The hot stamped component of claim 4, wherein an average thickness of the inter-diffusion layer ranges from 0.1 μm to 2 μm.

6. A method of manufacturing a hot stamped component, the method comprising:

applying an Si-based inorganic agent on a zinc-containing plating layer of a steel sheet and drying the applied Si-based inorganic agent to form a pre-post-treatment laver;

heating the steel sheet in a furnace for about 120 seconds to about 600 seconds, wherein during the heating a temperature of the steel sheet increases from about 700° C. to a temperature in a range of about Ac3 to about 910° C. at an average heating rate of about 1.5° C./second to about 7° C./second, thereby forming a surface layer on the plating layer comprising a Si layer and a Zn oxide layer, and forming an inter-diffusion layer at an interface between the plating layer and at least one of the Si layer and the Zn oxide layer, the inter-diffusion layer extending into at least one of the Si layer and the Zn oxide layer and comprising at least one of Si, Mn, O, Fe, Zn, and silicon oxide; and hot stamping the heated steel sheet to form the hot stamped component;

wherein the Si-based inorganic agent is applied to the steel sheet to a thickness of 0.5 μm to 3 μm to form the pre-post-treatment layer, wherein an amount of the applied Si-based inorganic agent is 0.5 $g/m^2$ to 3 $g/m^2$, and wherein a tensile strength of the hot stamped component is 1680 MPa or more.

7. The method of claim 6, wherein an area ratio of the inter-diffusion layer to the Si layer is at least 10% but not more than 80%.

8. The method of claim 7, wherein the Si layer comprises at least one of Si, Mn, O, Fe, Zn, and silicon oxide as components diffused from the steel sheet and the plating layer, and an oxide of the Si-based inorganic agent.

9. The method of claim 6, wherein an average thickness of the Si layer is less than an average thickness of the Zn oxide layer, wherein the average thickness of the Si layer is 5% or more and less than 100% of the average thickness of the Zn oxide layer.

10. The method of claim 9, wherein the average thickness of the Si layer ranges from 0.5 μm to 3 μm, and the average thickness of the Zn oxide layer ranges from 1 μm to 10 μm.

11. The method of claim 10, wherein an average thickness of the inter-diffusion layer ranges from 0.1 μm to 2 μm.

12. The method of claim 6, wherein the Si-based inorganic agent is applied to the steel sheet and dried at a temperature of 70° C. to 150° C. for 1 second to 10 seconds.

* * * * *